US008720890B1

(12) United States Patent
D'Avanzo

(10) Patent No.: US 8,720,890 B1
(45) Date of Patent: May 13, 2014

(54) SLOT MACHINE AND METHOD OF USE

(76) Inventor: Scott D'Avanzo, Ladera Ranch, CA (US)

( * ) Notice: Subject to any disclaimer, the term of this patent is extended or adjusted under 35 U.S.C. 154(b) by 459 days.

(21) Appl. No.: 11/277,728

(22) Filed: Mar. 28, 2006

(51) Int. Cl.
*A63B 71/00* (2006.01)

(52) U.S. Cl.
USPC ..... 273/139

(58) Field of Classification Search
None
See application file for complete search history.

(56) References Cited

U.S. PATENT DOCUMENTS

| | | | | |
|---|---|---|---|---|
| 6,168,520 | B1 * | 1/2001 | Baerlocher et al. | 463/16 |
| 6,311,976 | B1 * | 11/2001 | Yoseloff et al. | 273/138.2 |
| 6,471,208 | B2 * | 10/2002 | Yoseloff et al. | 273/143 R |
| 6,599,193 | B2 * | 7/2003 | Baerlocher et al. | 463/27 |
| 6,620,045 | B2 * | 9/2003 | Berman et al. | 463/25 |
| 6,632,140 | B2 * | 10/2003 | Berman et al. | 463/18 |
| 6,709,332 | B2 * | 3/2004 | Adams | 463/20 |
| 6,712,694 | B1 * | 3/2004 | Nordman | 463/20 |
| 6,793,578 | B2 * | 9/2004 | Luccesi et al. | 463/20 |
| 6,960,134 | B2 * | 11/2005 | Hartl et al. | 463/20 |
| 6,974,129 | B2 * | 12/2005 | Nordman | 273/143 R |
| 6,997,804 | B2 * | 2/2006 | Berman | 463/20 |
| 7,040,984 | B2 * | 5/2006 | Mead | 463/16 |
| 7,074,127 | B2 * | 7/2006 | Cuddy et al. | 463/20 |
| 7,090,580 | B2 * | 8/2006 | Rodgers et al. | 463/20 |
| 7,169,045 | B2 * | 1/2007 | Nordman | 463/20 |
| 7,241,220 | B2 * | 7/2007 | Rothkranz et al. | 463/20 |
| 7,258,609 | B2 * | 8/2007 | Nordman et al. | 463/20 |
| 7,270,604 | B2 * | 9/2007 | Gerrard et al. | 463/16 |
| 7,278,638 | B2 * | 10/2007 | Nordman | 273/292 |
| 7,666,093 | B2 * | 2/2010 | Lafky et al. | 463/26 |
| 8,404,993 | B2 * | 3/2013 | Heck | 219/121.54 |
| 2004/0048644 | A1 * | 3/2004 | Gerrard et al. | 463/16 |
| 2007/0218982 | A1 * | 9/2007 | Baerlocher | 463/27 |
| 2007/0249419 | A1 * | 10/2007 | Tarantino | 463/25 |

* cited by examiner

*Primary Examiner* — Kurt Fernstrom
*Assistant Examiner* — Dolores Collins
(74) *Attorney, Agent, or Firm* — Rob L. Phillips; Greenberg Traurig, LLP

(57) ABSTRACT

A method of conducting a wagering game incorporating an opportunity for a player to increase a primary game award is disclosed. A slot machine primary game award may be increased or decreased pursuant to an optional bonus game. Should the player elect not to play the bonus game, the player is paid the primary game award. Otherwise, the bonus game is conducted and the primary game award is increased, decreased or maintained constant. In one version, a threshold primary game award (e.g., $10.00) triggers the bonus game option.

22 Claims, 2 Drawing Sheets truth or dare truth or dare
Fig. 3 _Bonus Game Screen
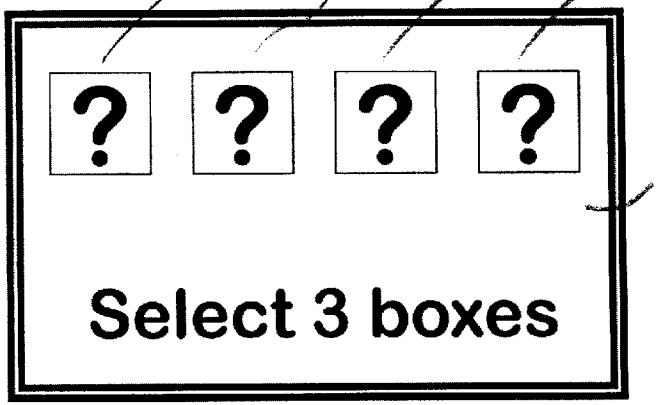
Fig. 4
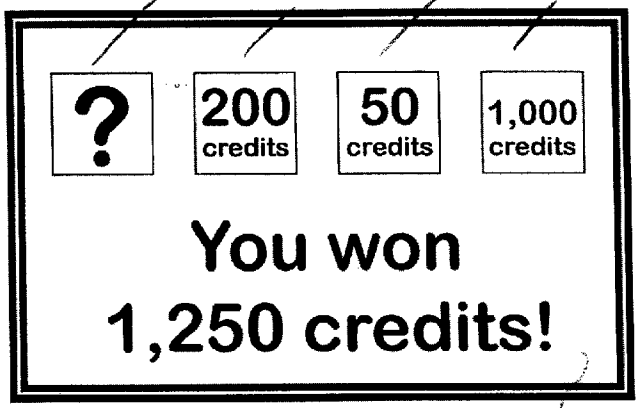
Fig. 5
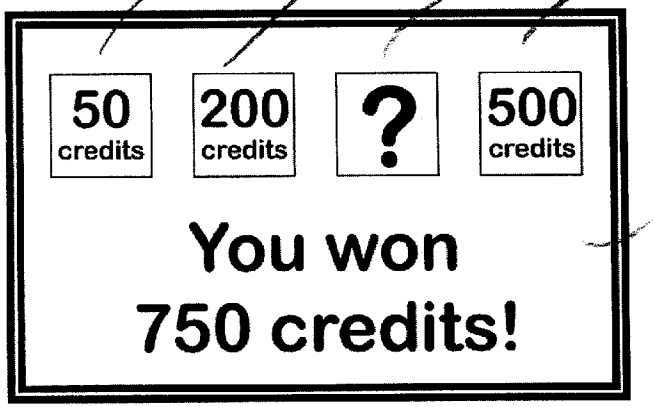

SLOT MACHINE AND METHOD OF USE

FIELD OF THE INVENTION

The embodiments of the present invention relate to an electronic gaming device in the form of a slot machine. More particularly, the embodiments relate to a slot machine having a bonus feature allowing a player to risk, in hopes of increasing, a primary game award.

BACKGROUND

Electronic gaming devices, like slot machines, now account for over 60% of gaming revenue in casinos. Accordingly, new slot machine concepts are in increasing demand to satisfy the gaming public. Recent slot machine advances include large progressive jackpots, video graphics and bonus games.

In particular, bonus games are now integrated in a majority of the slot machines in the marketplace. For example, the Wheel of Fortune slot machines include a bonus game in the form of a numbered mechanical wheel. The bonus game, namely the wheel, is activated in response to pre-established primary game outcomes. Other bonus games comprise video-implemented games, ball-hoppers and player-selected outcomes.

To date, bonus games have been dedicated to providing a player a bonus or additional award. That is, in many instances, the bonus game award is the single award since no primary game award is required to trigger most bonus games. To the contrary, bonus games are typically triggered based on a pre-established primary game outcome having no corresponding monetary award (e.g., a bonus game symbol on reel three aligned along a device payline). Thus, it would be advantageous for a bonus game to provide an opportunity for a player to enhance a primary game award.

SUMMARY

Accordingly, a first embodiment of the present invention comprises a method of conducting a wagering game comprising: accepting a player wager; providing means for a player to activate a series of game reels, said game reels depicting game indicia; providing a primary game award in response to a group of pre-established winning alignments of the game indicia; triggering a bonus game option in response to certain of the pre-established winning alignments of the game indicia; and in response to the triggering of the bonus game option, offering a player an opportunity to either play the bonus game whereby the primary game award may be increased or decreased, or not play the bonus game thereby causing the primary game award to be paid out.

In practice, in response to certain pre-established primary game awards a player may risk the primary game award by playing a bonus game in an effort to increase the primary game award at the risk of decreasing the primary game award. The bonus game may take many forms, including video or mechanical, provided it facilitates the embodiments of the present invention.

Other variations, embodiments and features of the present invention will become evident from the following detailed description, drawings and claims.

BRIEF DESCRIPTION OF THE DRAWINGS

FIG. 3 shows the bonus game display device in response to a player selecting to play the bonus game;

FIG. 4 shows the bonus game display after a player has selected three boxes; and FIG. 5 shows the bonus game display after a player has selected an alternative group of the three boxes.

DETAILED DESCRIPTION

Figure 2:
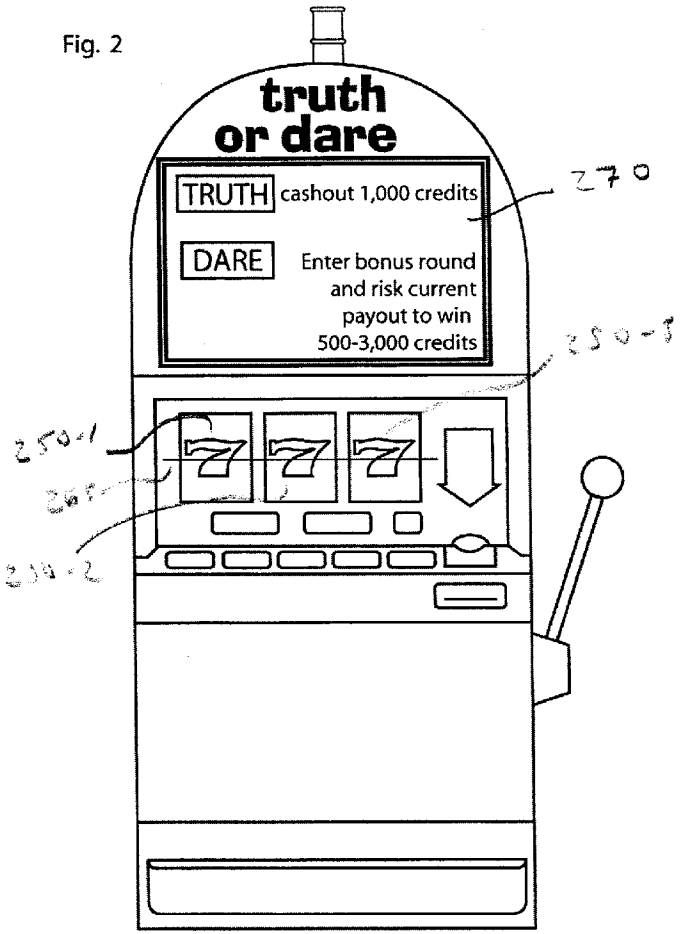
FIG. 2 shows a bonus game display activated in response to a pre-established primary game outcome.

The operation of slot machines is controlled by microprocessors which communicate with internal memory devices and the external features of the machines. The microprocessors also incorporate, or communicate with, a random number generator which ensures the randomness of the machines' outcomes. In the embodiments of the present invention, one or more processors, along with memory and related devices, control the new applications disclosed herein. Therefore, the embodiments, along with the corresponding odds, of the present invention may be programmed into the processor or associated software. Since the technology for operating and controlling slot machines is well known to those skilled in the art, the subtle details are not described herein.

For the purposes of promoting an understanding of the principles in accordance with the embodiments of the present invention, reference will now be made to the embodiments illustrated in the drawings and specific language will be used to describe the same. It will nevertheless be understood that no limitation of the scope of the invention is thereby intended. Any alterations and further modifications of the inventive feature illustrated herein, and any additional applications of the principles of the invention as illustrated herein, which would normally occur to one skilled in the relevant art and having possession of this disclosure, are to be considered within the scope of the invention claimed.

Figure 1:
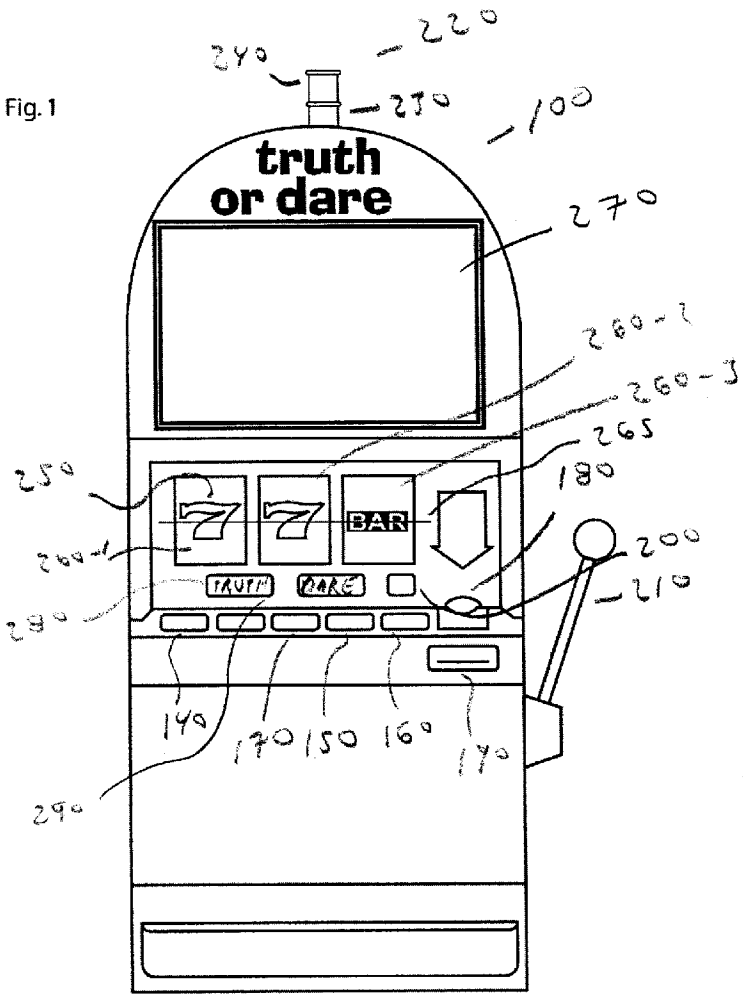
FIG. 1 shows an electronic gaming device of the type that may facilitate the embodiments of the present invention.

Reference is now made to the figures wherein like parts are referred to by like numerals throughout. FIG. 1 illustrates a gaming device 100 for facilitating the embodiments of the present invention. The device 100 includes interface buttons, including a one coin/unit wager button 140, maximum coins/units button 150, spin button 160 and cash out button 170. The device 100 also includes a coin input 180, card reader 190, credit display 200 and slot arm 210. Optionally, the device 100 may incorporate a currency and coupon reader. A conventional slot machine candle 220 comprises two sections which may be illuminated by internal light sources. The color of the lower section 230 identifies the denomination of the device 100 and a blinking upper section 240 is used to notify casino personnel that the player needs change or other assistance conventionally provided by casino personnel.

Game indicia 250 are depicted on three gaming reels 260-1 through 260-3. Primary game outcomes are determined by alignment of the game indicia along payline 265. The gaming reels 260-1 through 260-3 may be mechanical or video generated. With video generated reels, there may be up to nine (or more) simultaneously displayed game indicia forming a 3×3 grid (i.e., three on each reel) and multiple designated paylines. A bonus game is facilitated by display device 270. The display device 270 is activated in response to certain pre-established primary game outcomes.

FIG. 2 shows three identical gaming indicia 250-1 through 250-3, namely three 7 symbols, aligned along payline 265. As a result, the player is afforded the opportunity to risk a primary game award by playing a bonus game. One or more pre-established winning game indicia alignments may trigger the bonus game option while alignments corresponding to lesser primary game awards may not trigger the bonus game option. In one embodiment, the bonus game option is triggered in response to a primary game award exceeding a threshold amount (e.g., $10.00). Alternatively, the bonus game option may be triggered in response to winning gaming indicia alignments regardless of the amount of the primary game award. The bonus option may also require that the player play a maximum number of coins or credits. As shown, the display device 270 provides the player with an option of accepting the primary game award of 1000 credits or risking the 1000 coins to increase or decrease the primary game award to between 500-3000 credits. One game embodiment is promoted under the Truth or Dare title. The Truth option coincides with a player's election to accept a primary game award while the Dare option coincides with a player's election to risk enhancing or reducing the primary game award. The player may elect the Truth or Dare options via touch screen technology implemented in the display device 270 or via Truth and Dare buttons 280, 290, respectively, near the game interface buttons.

FIGS. 3-5 show the display device 270 depicting a series of bonus game stages. After a player has elected to enhance or reduce the primary game award, the bonus game is presented. FIG. 3 shows one type of bonus game in the form of multiple award boxes 280-1 through 280-4. The player, as instructed, must then select three boxes which aggregately determine the player's total award for the instant play of the device. The boxes may be selected via touch screen technology implemented in the display device 170, game interface buttons or any other suitable means. FIG. 4 shows a first outcome based on the player selecting boxes 280-2 through 280-4 resulting in a bonus award of 1,250 credits. Accordingly, the player has increased the primary game award of 1000 credits by 250 credits resulting in a total award of 1,250 credits. FIG. 5 shows an alternative outcome based on a player selecting boxes 280-1, 280-2 and 280-4 resulting in a bonus award of 750 credits. Accordingly, the player's election to play the bonus game has resulted in a loss of 250 credits resulting in an award of 750 credits. It is conceivable that the player may exit the bonus game with the same number of credits as the original primary game award.

In one game embodiment, a player may be provided consecutive Truth or Dare options during a single bonus game so that a player may significantly increase the primary game award. Ideally, a player is provided with a minimum and maximum possible award achievable during each bonus game round. Thus, the player knows in advance the downside and upside before electing to accept or risk the current award. Ideally, the player cannot lose the entire primary game award during the bonus game but some more aggressive embodiments can include a total loss of the primary game award. With a total loss possible, the potential increase to the primary game award may be significant to justify the risk.

It should be understood that any type of bonus game can be implemented to allow the player the option of risking the primary game award. For example, the bonus game may include animation and/or non-interactive elements (i.e., the device randomly selects instead of the player selecting). Indeed, different bonus games may be presented on the same device during the same game session. The bonus game awards may also provide the player with an option to risk a primary game award against a number of free device spins, multipliers, bonus credits or other prizes.

Although the invention has been described in detail with reference to several embodiments, additional variations and modifications exist within the scope and spirit of the invention as described and defined in the following claims.

I claim:

1. A method of conducting a wagering game comprising:

accepting a player wager;

providing means for a player to activate a series of game reels, said game reels depicting game indicia;

identifying a series of primary game awards winnable in response to a group of pre-established winning alignments of the game indicia;

paying a primary game award for certain of the pre-established winning alignments of the game indicia and triggering a bonus game option in response to other certain of the pre-established winning alignments of the game indicia wherein triggering of said bonus game option is triggered prior to paying an associated primary game award to said player; and in response to the triggering of the bonus game option, offering a player an opportunity to either play the bonus game whereby the associated primary game award is not paid to the player but used as a wager on an outcome of the bonus game such that the primary game award is increased or decreased depending on an outcome of the bonus game, or not play the bonus game thereby causing the associated primary game award to be paid to the player.

2. The method of claim 1 further comprising displaying a range of potential awards corresponding to the player electing to play the bonus game.

3. The method of claim 1 further comprising triggering a bonus game having multiple player-selectable outcomes.

4. The method of claim 1 further comprising triggering a bonus game including animation.

5. The method of claim 1 further comprising means for the player to elect or decline to play the bonus game.

6. The method of claim 1 further comprising triggering a bonus game wherein the opportunity to increase or decrease the primary game award is at least partially determined by free game plays, multipliers and/or bonus credits.

7. The method of claim 1 further comprising triggering the bonus game option in response to a primary game award exceeding a threshold value.

8. The method of claim 7 further comprising requiring the player to play a maximum number of coins or credits.

9. The method of claim 1 further comprising triggering the bonus game option in response to winning gaming indicia alignments regardless of the amount of the primary game award.

10. The method of claim 9 further comprising requiring the player to play a maximum number of coins or credits.

11. The method of claim 1 further comprising requiring the player to play a maximum number of coins or credits in order to receive the opportunity to play the bonus game.

12. A method of conducting a wagering game comprising:

accepting a player wager;

providing means for a player to activate a series of game reels, said game reels depicting game indicia;

identifying a series of primary game awards winnable in response to a group of pre-established winning alignments of the game indicia;

responsive to pre-established winning alignments of the game indicia corresponding to a bonus game option, offering a player an opportunity, via a bonus game and prior to an associated primary game award being paid to said player, to wager the primary game award on an outcome of said bonus game which results in an increase or decrease the associated primary game award based on the outcome of said bonus game;

in response to the player electing not to play the bonus game, paying the player the associated primary game award;

in response to the player selecting to play the bonus game, not paying the associated primary game award to the player and advancing to a bonus game wherein the player wagers the associated primary game award on an outcome of said bonus game resulting in an increase or decrease of the associated primary game award depending on said outcome of the bonus game; and conducting the bonus game and paying the player any resultant award based on the bonus game outcome and wagered associated primary game award.

13. The method of claim 12 further comprising displaying a range of potential awards corresponding to the player electing to play the bonus game.

14. The method of claim 12 further comprising triggering a bonus game having multiple player-selectable options.

15. The method of claim 12 further comprising triggering a bonus game including animation.

16. The method of claim 12 further comprising means for the player to elect or decline to play the bonus game.

17. The method of claim 12 further comprising providing the bonus game in response to a primary game award exceeding a threshold value.

18. The method of claim 17 further comprising requiring the player to play a maximum number of coins or credits.

19. The method of claim 12 further comprising triggering the bonus game option in response to winning gaming indicia alignments regardless of the amount of the primary game award.

20. The method of claim 19 further comprising requiring the player to play a maximum number of coins or credits.

21. The method of claim 12 further comprising requiring the player to play a maximum number of coins or credits in order to receive the opportunity to play the bonus game.

22. The method of claim 12 further comprising advancing to a bonus game wherein the opportunity to increase or decrease the primary game award is at least partially determined by free game plays, multipliers and/or bonus credits.

* * * * *